US006591515B2

(12) United States Patent
Kinard et al.

(10) Patent No.: US 6,591,515 B2
(45) Date of Patent: Jul. 15, 2003

(54) MOBILE INCLINE KINETIC EVAPORATOR

(75) Inventors: John Tony Kinard, Greer, SC (US); Michael John Maich, Greenville, SC (US); Brian John Melody, Greer, SC (US); Duane Earl Stenzinger, Simpsonville, SC (US); David Alexander Wheeler, Williamston, SC (US); Keith Lee Moore, Greenville, SC (US)

(73) Assignee: Kemet Electronics Corporation, Greenville, SC (US)

( * ) Notice: Subject to any disclaimer, the term of this patent is extended or adjusted under 35 U.S.C. 154(b) by 0 days.

(21) Appl. No.: 09/948,716

(22) Filed: Sep. 10, 2001

(65) Prior Publication Data

US 2003/0046824 A1 Mar. 13, 2003

(51) Int. Cl.[7] ..... F26B 13/30

(52) U.S. Cl. ..... 34/92; 34/361; 34/368; 34/586

(58) Field of Search ..... 34/92, 360, 361, 34/368, 406, 586

(56) References Cited

U.S. PATENT DOCUMENTS 4,330,946 A 5/1982 Courneya
4,357,760 A * 11/1982 Muxxchoot ..... 34/573
4,611,469 A * 9/1986 Musschoot ..... 62/100
4,769,249 A * 9/1988 Webb ..... 426/438
4,974,334 A * 12/1990 Roddewig ..... 34/10
5,433,020 A * 7/1995 Leech, Jr. ..... 34/403
5,460,717 A 10/1995 Grimwood et al.
5,659,971 A 8/1997 Haleen
5,709,036 A 1/1998 Haleen
5,746,007 A 5/1998 Haleen
6,041,515 A 3/2000 Ally et al.
6,080,429 A 6/2000 Cleland et al.
6,143,221 A 11/2000 Gurol

* cited by examiner

*Primary Examiner*—Ira S. Lazarus
*Assistant Examiner*—Kathryn S. O'Malley
(74) *Attorney, Agent, or Firm*—Banner & Witcoff, Ltd.

(57) ABSTRACT

An apparatus is disclosed for drying materials wet with one or more solvents, particularly hygroscopic materials and materials wet with a high boiling point (low vapor pressure) solvent that are sensitive to heat. Wet material is loaded into a chamber, which is then sealed and caused to oscillate back and forth. Vacuum is enlisted to provide rapid evaporation of solvent at a lower temperature than possible at standard atmospheric pressure. The material is oscillated until a sudden decrease in the residual pressure of the chamber, which indicates completion of the drying cycle. Because vacuum is applied to an oscillating chamber, a rotary vacuum seal is not required to accomplish drying in accordance with the practice of the instant invention.

11 Claims, 7 Drawing Sheets

MOBILE INCLINE KINETIC EVAPORATOR

FIELD OF THE INVENTION

The present invention relates to drying wet material within a drying chamber. In particular, the present invention relates to drying wet material within an oscillating drying chamber under vacuum such that a rotary vacuum seal is not required.

BACKGROUND OF THE INVENTION

In the chemical process industries, it is frequently necessary to dry granulated or powdered materials that are wet with one or more solvents. The materials to be dried may be the product of precipitation of solids from solution, such as in fractional crystallization, or may have become wet as the result of one or more washing procedures. The materials to be dried may also have become wet as the result of a coating process in which a solution or suspension of one or more substances is mixed with or sprayed onto the material to be coated, thereby necessitating a drying step before further processing. Sometimes granulated or powdered materials absorb moisture or solvent vapors from an atmosphere containing these materials. The absorbed moisture or solvent must be removed in order to render the powdered or granulated material suitable for its intended use.

A variety of drying chambers, ovens, etc. have been developed over the years in answer to the needs of the chemical and process industries. The drying method employed by these dryers generally involves passing a flow of relatively dry air past or through material while exposing fresh surface area. Wet material is exposed by stirring or tumbling the material in a rotating drier, or by passing air through the material in a fluidized bed.

For very hygroscopic materials and materials wet with a high boiling point (low vapor pressure) solvent, simple drying in a current of dry air may not be sufficient to remove the moisture from the powdered or granulated material. Where simple air drying is insufficient, the temperature of the air, material, or both may be raised in order to increase the vapor pressure of the solvent wetting the powdered or granulated material. Increase of vapor pressure accelerates evaporation of the solvent.

There have been many types of dryers or evaporators developed for the purpose of drying powdered or granulated materials that supply heat input during the drying process. Some evaporators (dryers) make use of a simple heated chamber, with or without stirring of the material to be dried. Some evaporators make use of a heated interior wall combined with rotation to help drive off the solvent by exposing fresh surface area, etc.

The drying of powders or granulated materials may be complicated if the material to be dried is highly hygroscopic or wet with a high boiling point (low vapor pressure) solvent and is also sensitive to thermal degradation. For example, some pharmaceutical agents are heat-sensitive and cannot be dried by simple heating without severe degradation. Another example of a material that cannot easily be heated to drive off moisture is metal or ceramic powder that has been coated with a solution of a binder or lubricant. Binders aid in pressing powdered material into pellets and, after further consolidation via a thermal sintering step, are useful as filter elements, electrolytic capacitor anodes, etc. Simple heating, even with tumbling, may melt the solid binder/lubricant as the moisture or solvent evaporates. This results in the production of large agglomerates, or clumps, which are unsuitable for downstream processing.

In order to address the problem of drying heat-sensitive materials, vacuum is enlisted to facilitate rapid evaporation of the solvent at a lower temperature than is possible at standard atmospheric pressure. The use of vacuum without agitation is sufficient to thoroughly dry powders or granulated solids in thin layers, but experience has demonstrated that thick layers of material dry very slowly under these conditions. This appears to result from the increase in pressure on the material below the surface due the weight of the material above. Thus, agitation of the material to be dried is employed in order to expose fresh surface area to vacuum. While agitation may be accomplished by the use of impeller blades to stir the material, in practice agitation is usually accomplished by use of a rotary evaporator. A rotary evaporator features a rotating vacuum chamber containing the material to be dried, and connects to a vacuum source through a rotary vacuum seal. FIG. 1 displays a typical rotary vacuum evaporator of the prior art. The vacuum evaporator contains a rotary chamber 101. The top of the chamber has an outlet neck 102. A fixed vacuum line 103 is placed into the neck and attached with a rotating chamber clamp 104. A rotating vacuum seal 5 and a fixed vacuum seal 106 are used to create an air-tight seal. The chamber is connected to a rotating drive housing 107 and a rotating drive gear 108 to rotate chamber 101 almost in the horizontal plane. Above the gear and attached to the fixed vacuum line 103 through fixed chamber clamp 110 is a fixed housing 109. Arrows 111 depict the direction of the vapor path to the vacuum pump. The "wet material" is poured into 101 before connection to the rotary seal/rotary drive mechanism.

Heat may be applied by immersing the lower portion of 101 in a heated fluid such as hot water or oil. Heat is generally supplied to the material contained within the rotary evaporator to compensate for cooling due to the latent heat of vaporization of the solvent absorbed as it evaporates. The amount of heat required and the rate of input of thermal energy necessary to compensate for evaporative cooling may be calculated very accurately based upon the latent heat of vaporization of the solvent and the desired drying time for the amount of solvent to be removed.

Although rotary vacuum evaporators have been used successfully for many years in drying heat-sensitive powders or granulated materials, there are problems associated with the use of rotary vacuum seals. Rotary vacuum seals are necessary to communicate vacuum from the vacuum pump to the rotary chamber containing the material to be dried. During the drying process, evaporation of the solvent tends to be rapid (generally, process cost is reduced as the rate of evaporation is increased). Rapid evaporation of the solvent tends to displace some of the material being dried from the wet bulk material to an empty portion of the vacuum chamber over the bulk material. The effect is sufficiently pronounced that, with glass or other transparent vacuum vessels, the completion of the drying step may be readily detected as cessation of the agitation of the powder surface due to evaporation of the solvent as the vacuum vessel rotates.

Evaporation of the solvent from wet material in a rotary evaporator also results in transport of a portion of the material being dried towards the source of vacuum via vapors of the evaporating solvent. For applications involving drying of abrasive materials, such as tungsten carbide powder (used to fabricate cutting tools), tantalum powder (used to fabricate electrolytic capacitor anodes), etc., vapor transport of these materials to the seal area results in rapid wear of the rotary vacuum seal. Wear of the vacuum seal causes loss of vacuum integrity and process efficiency, as well as contamination of the material being dried by particles of the degraded seal. Filters may be used to extend the life of the rotary vacuum seal, but the fundamental problem of seal wear remains. Further, rapid wear of the vacuum seal necessitates frequent replacement of the seal, which increases process costs and machine down time. Accordingly, what is needed is a drying method and apparatus that permits vacuum enhanced drying, yet is free of the shortcomings associated with use of a vacuum seal.

BRIEF SUMMARY OF THE INVENTION

It is often desirable to dry powdered or granulated materials that are wet with one or more solvents. These materials may be particularly hygroscopic materials and/or materials wet with a high boiling point (low vapor pressure) solvent and which are sensitive to heat. It is further desirable to dry such materials in an oscillating chamber, which encloses the wet material, wherein vacuum is applied to the chamber to expedite solvent evaporation at a pressure reduced from that of standard atmospheric pressure.

The invention is directed to an oscillating vacuum chamber dryer for drying wet material that does not require use of a rotary vacuum seal. The invention is further directed to a method for drying wet material in an oscillating vacuum chamber dryer that does not require use of a rotary vacuum seal.

Specifically, the present invention is directed to an oscillating vacuum chamber dryer for drying wet powdered or granulated materials comprising: a drying chamber having a vacuum port, the vacuum port coupled to a vacuum source to produce a vacuum in the drying chamber, the drying chamber coupled to an oscillation mechanism configured to cause the chamber to reversibly rock back and forth in an oscillatory manner.

The invention is further directed to a process for drying a coated powdered or granulated material comprising introducing the material into a chamber of an oscillating vacuum chamber dryer, supplying a liquid to the chamber, rocking the chamber back and forth in an oscillatory manner to cause the material and liquid to flow back and forth from one end of the chamber to the other, allowing the liquid to coat the material and continuously exposing fresh surface area, and, while maintaining the rocking, applying a vacuum to the chamber through a vacuum port until the material has dried.

DETAILED DESCRIPTION OF THE INVENTION

Figure 1:
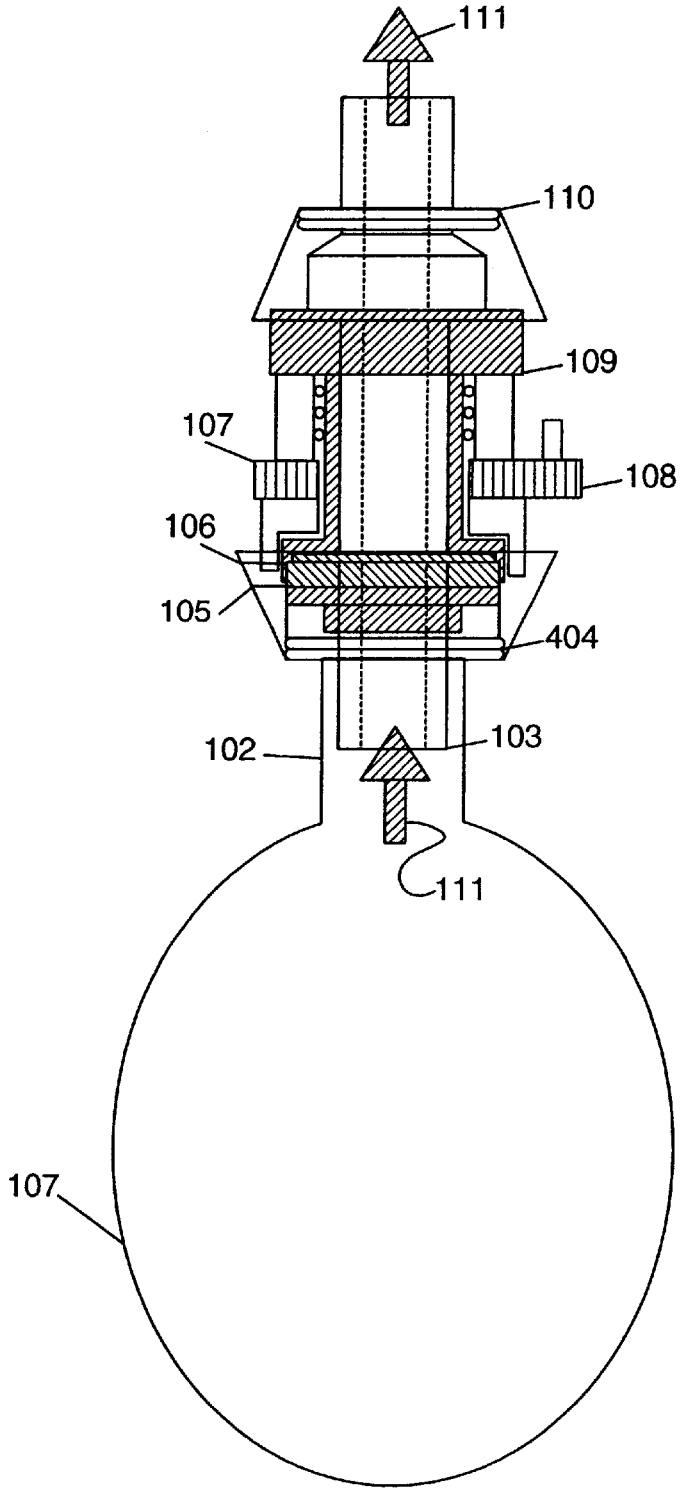
FIG. 1 Prior Art
FIG. 1 shows a rotating vacuum chamber of the prior art.
Figure 2:
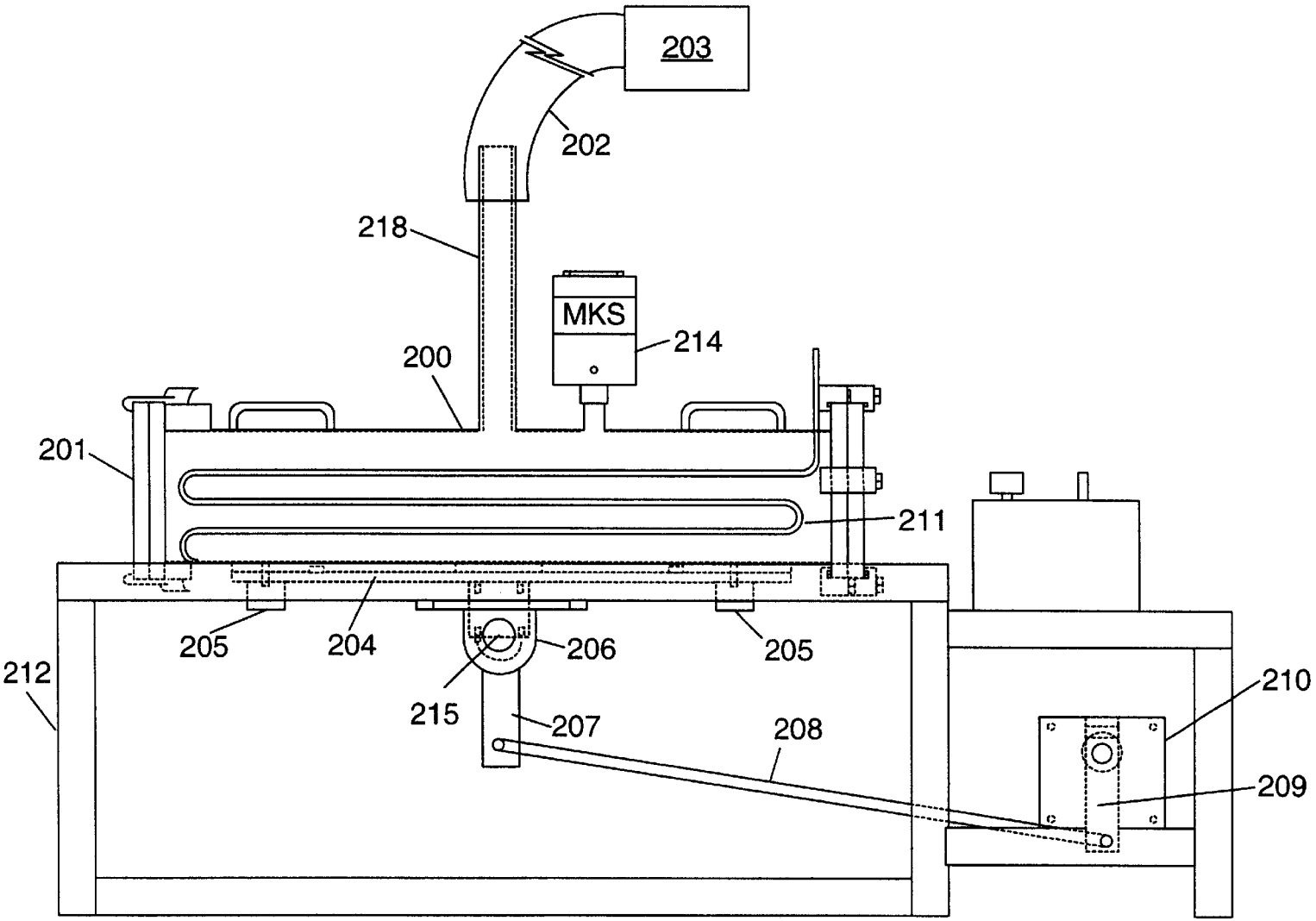
FIG. 2 shows a side view partially in section of the present invention.

The present invention replaces the rotating vacuum chamber of the prior art as shown in FIG. 1 with an oscillating vacuum chamber. FIG. 2 depicts a side view of a preferred embodiment of the present invention. The vacuum chamber 200 is operatively coupled to a source of vacuum 203 via tubing 202. Operatively coupled in the context of the present invention is intended to encompass any apparatus interconnecting the vacuum chamber to the source of the vacuum during operation so that the coupled elements operate as intended. The tubing 202 is adapted to accommodate the oscillatory motion of the vacuum chamber 200 by maintaining flexibility in the connection between the vacuum chamber 200 and vacuum source 203. No rotary vacuum seal or similar structure is necessary between the vacuum chamber 200 and tubing 202. Preferably the tubing is merely placed over an exit port 218 on chamber 200.

Vacuum chamber 200 is configured with an opening and removable cap 201, which may be positioned on the chamber body, such as on the side or on either end of the chamber. The embodiment shown in FIG. 2 illustrates the removable cap 201 as being on one end of the vacuum chamber 200, but alternate embodiments of the invention may feature the removable cap on the side or on either end of the chamber or both ends of the chamber concurrently.

Vacuum chamber 200 is coupled to and supported by support structure 204. Vacuum chamber 200 and support structure 204 can be supported by frame 212. The coupling between vacuum chamber 200 and support structure 204 is accomplished by any suitable fastening mechanism, such as bolts, screws, rivets, weld, etc. In the embodiment shown in FIG. 2, Vacuum chamber 200 is coupled to support structure 204 via bolts 205.

Figure 4:
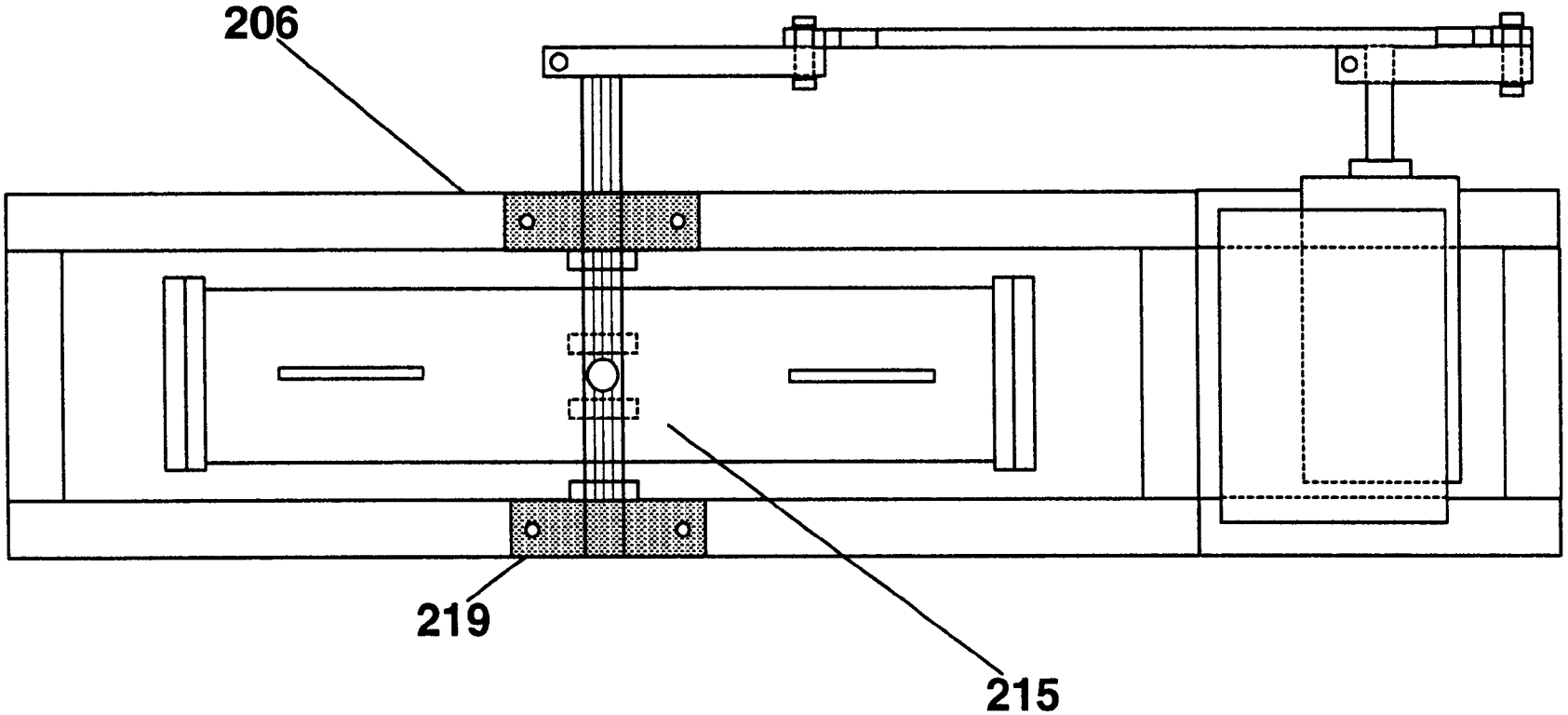
FIG. 4 shows a schematic top view of an embodiment of the invention.

Support structure 204 is pivotally coupled to bearing 206 through support rod 215 and reversibly rotates back and forth in an oscillatory manner about the bearing. The oscillatory motion of support structure 204 is caused by the action of motor 210. Support structure 204 is coupled to motor 210 through lever 207, connecting shaft 208, and revolving crank 209. In operation, motor 210 drives revolving crank 208, which in turn imparts oscillatory motion to support structure 204 via connecting shaft 208 and lever 207. FIG. 4 shows a top view of the apparatus and the positions of bearing 206 and bearing 219, support rod 215, lever 207, and crank 208.

Prior to use, the vacuum chamber 200 is inclined such that cap 201 is elevated. Cap 201 is then removed and the material to be dried loaded into the chamber. Cap 201 is then replaced, and motor 210 started in order to begin the oscillatory motion and vacuum source 203 applied to the chamber 200. The alternate raising and lowering of each end of the chamber 200 causes the wet material inside the chamber to flow back and forth from one end of the chamber 200 to the other. The back and forth flow of material continuously exposes fresh surface area to the vacuum draw, thus causing drying of the material.

Figure 6:
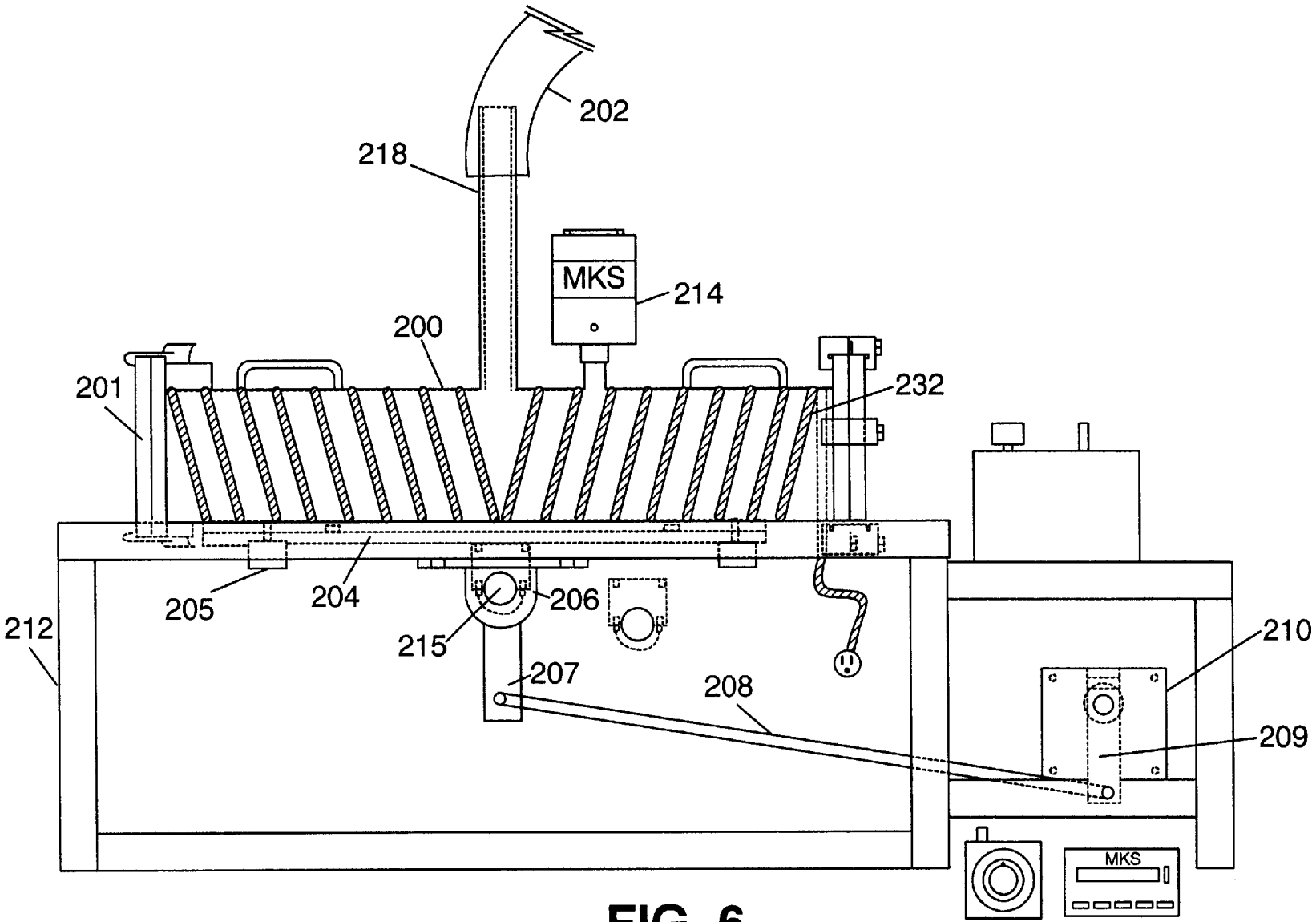
FIG. 6 shows another embodiment of the invention utilizing electrical tape.

Thermal energy may be provided in order to compensate for heat loss due to evaporative cooling. The thermal energy may be supplied to the vacuum chamber 200 via any appropriate means. FIG. 2 depicts a water line trace 211. FIG. 6 depicts an electrical heat tape 232. The vacuum should be capable of reducing the pressure in the chamber.

Drying is complete and the solvent evaporated when there is a relatively sudden drop of pressure in the chamber. This is occasioned by the vacuum in the chamber no longer being replaced by the evaporated solvent. The pressure drops at the complete removal of the solvent due to the lower vapor pressure of the substrate material being dried. The sudden drop in the residual pressure of the chamber 200 may be observed via any appropriate means such as electronic vacuum gauge 214.

Figure 3:
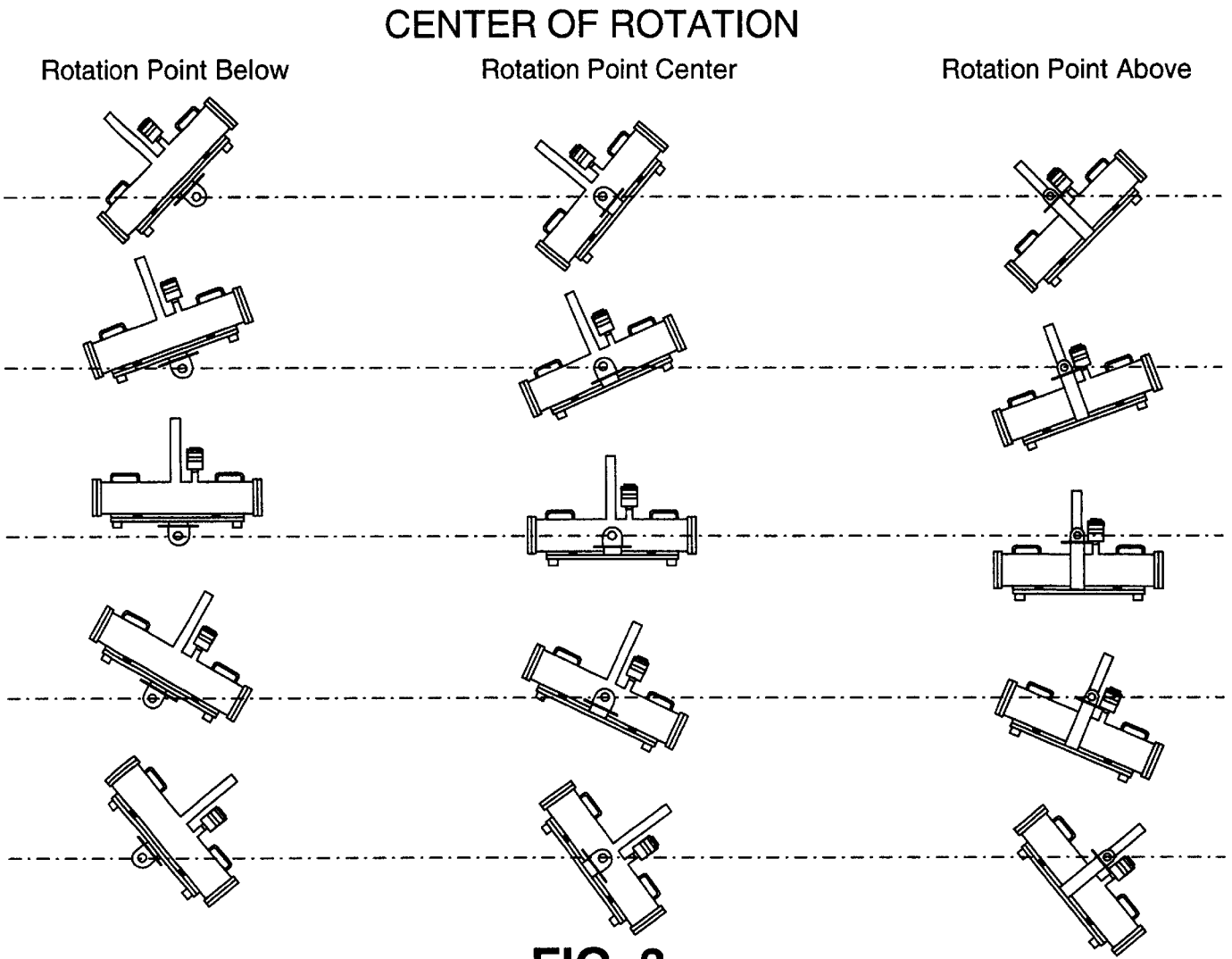
FIG. 3 show several rotational pattern of oscillatory motion of the drying chamber of the invention.

FIG. 3 illustrates the rotational pattern of the vacuum chamber's oscillatory motion. The vacuum chamber is supported so as to enable balanced rotation about its center of gravity 300. The rotation of the chamber causes its major axis to rise above and fall below the horizontal reference axis, forming angles 301 and 302 respectively. The vacuum chamber thus moves with a rocking or "see-saw" action throughout the drying process. The motion of the chamber causes the material inside to slide back and forth in rhythm with the chamber's oscillatory movement. The material in the chamber is thus churned and fresh surface area continually exposed to the draw of the vacuum.

A rotary vacuum seal on the chamber can be omitted from the design because the chamber rocks back and forth. It does not rotate. The back and forth movement of the material within the chamber creates inertia which opposes the vacuum draw. Additionally, the tubing that connects the vacuum chamber to the vacuum source introduces gravitational opposition to material entrained in the solvent vapor stream. Thus, wet material may be effectively dried without the shortcomings associated with a vacuum chamber seal.

Figure 5:
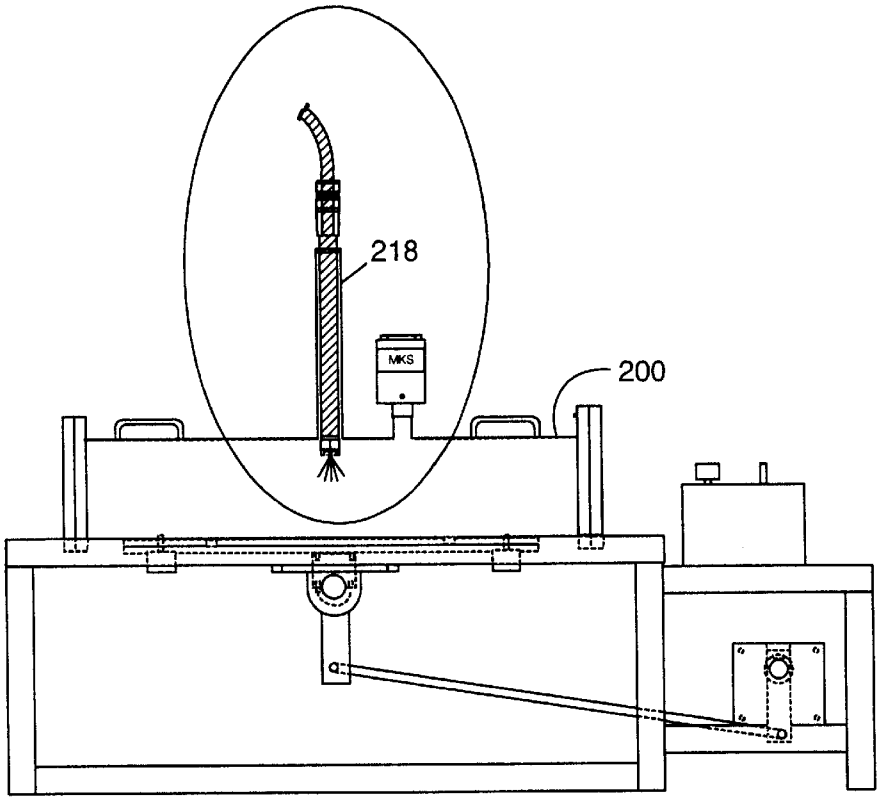
FIGS. 5 and 5A show a schematic of a spray nozzle assembly used with the present invention.
Figure 5A:
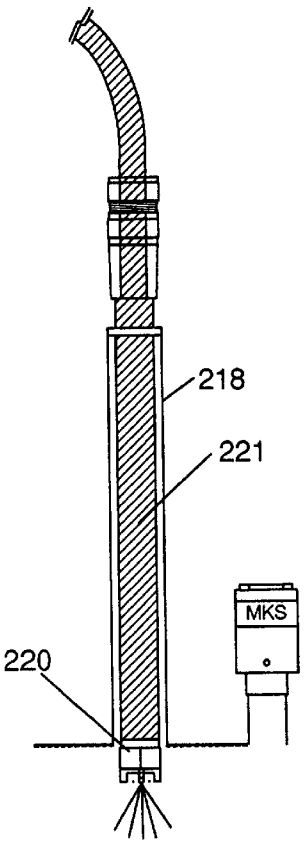

FIG. 5 illustrates an alternate embodiment of the invention wherein the vacuum chamber is configured to provide spray coating of binder or lubricant. FIG. 5A provides details of the spray coating assembly. A hose or flexible pipe 221 is inserted into exit port 218 and has connected thereto a spray nozzle 220. Coating material such as a binder or lubricant is supplied to spray nozzle 220 through the hose or flexible pipe 221, which is connected at its other end to a source of coating material (not shown).

EXAMPLE

The following illustrative example is provided for a better understanding of the invention. The example is illustrative of preferred aspects of the invention and is not intended to limit the scope of the invention.

A prototype mobile incline kinetic evaporator was constructed as described above and having a vacuum chamber 24 inches long and 4 inches in diameter. The vacuum connection was made with a length of 1-inch internal diameter vacuum hose that was approximately 20 feet long and suspended by coil springs not shown so as to form a large vertical loop between the vacuum pump and the evaporator. The vacuum pump used was a water ring pump equipped with a 5 horsepower motor. The vacuum chamber was traced with heat tape (500 watt rating) and covered with rubber thermal insulation. The evaporator was charged several times with capacitor grade tantalum powder containing 2% dimethyl sulfone binder and 8% water. Vacuum was applied to each charge of the wet binder-coated tantalum powder, with the chamber oscillating at an angle of +/−35 degrees from the horizontal at a rate of several oscillations per minute. The temperature within the chamber was raised to 50–65° C. during the course of each drying run.

A sudden reduction in residual pressure in the chamber from 5–15 mm Hg to less than 2 mm Hg indicated the end of the drying run. The reduction in residual pressure signaled that the residual moisture had been reduced to a level well under 0.1%. The time required for the residual pressure to reach approximately 2 mm Hg was always within 10–15% of the ideal (theoretically calculated), which is calculated as the time required to input the thermal energy equivalent to the latent heat of vaporization of the moisture present in the powder.

After testing several lots of tantalum powder processed in accordance with the present invention, in each case the moisture content of the tantalum powder/binder blend was reduced to less than about 350 ppm, which is less than about 0.035%. This is approximately the level of moisture found in the incoming tantalum powder prior to wetting. The tantalum powder dried in the evaporator of the present invention was found to be free-flowing and suitable for further processing.

The amount of material lost due to entrainment in and transport by the escaping moisture vapor (with no filter in place) was found to be approximately 1.5% +/−0.3% for the evaporator of the present invention. This compares very favorably with the 3–10% loss found with a rotary evaporator having similar capacity to the prototype of the present invention (again, with no filter installed). Losses can be even further reduced with the addition of a filter.

The evaporator of the present invention, then, successfully facilitates the elimination of the rotary vacuum seal present in rotary evaporators; provides efficient removal of water or other solvents from powdered or granulated materials; and minimizes material losses due to entrainment in the escaping vapor stream.

Figure 7:
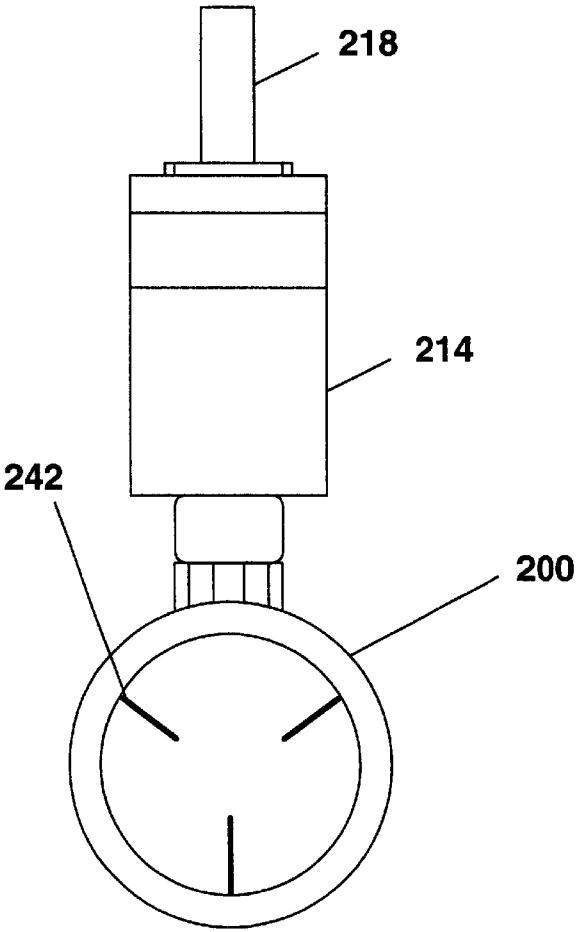
FIG. 7 shows a side view of another embodiment of the invention utilizing projections.

It should be recognized that several variations on the basic design of the illustrated embodiments may be made without departing from the scope of the present invention. For example, a transparent window can be placed in the side or end of the vacuum chamber to facilitate observation of the drying material during solvent evaporation. Additionally, though the illustrated embodiments depict the vacuum chamber as being cylindrical in shape, the chamber could be designed with any cross-section shape such as oval, triangular, square, rectangular, or hexagonal. Also, the interior of the chamber may be designed to include projections such as fins, ridges, vanes, as generally shown in FIG. 7. The design of such projections is within the skill of the art.

Moreover, the binder or coating solution may be applied to the material to be dried while it resides in the vacuum chamber. A filter may be installed in the exhaust path to prevent loss of the material being dried and/or damage to the vacuum system from vapor-transported particulates. Thermal energy may be supplied to the load by fabricating a shell surrounding the vacuum chamber of the evaporator such that warm water, or some other thermal transfer fluid, may be passed through the shell surrounding the vacuum chamber. Coolant may be passed through the same shell (or through tubing traces against the vacuum chamber) to cool the load once the solvent is removed. These methods are all extensions of the basic principles of design and operation of the present invention.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. An oscillating vacuum chamber dryer for drying wet powdered or granulated materials comprising:

a drying chamber having a vacuum port, the vacuum port coupled to a vacuum source to produce a vacuum in the drying chamber, the drying chamber coupled to an oscillation mechanism configured to cause the chamber to reversibly rock back and forth in an oscillatory manner.

2. The dryer of claim 1 wherein the vacuum port is connected to the vacuum source without a rotary seal.

3. The dryer of claim 1 wherein the vacuum port is connected to a vacuum source via flexible tubing connected to the vacuum port at one end and the vacuum source at the other end.

4. The dryer of claim 1 wherein the chamber has an opening with a removable cap attached thereto for adding the wet material to the chamber.

5. The dryer of claim 1 further comprising an internal source of temperature regulation.

6. The dryer of claim 5 wherein the source of temperature regulation is electric heat tape or fluid transfer lines.

7. The dryer of claim 1 further comprising means to introduce a liquid to the chamber.

8. The dryer of claim 7 wherein the means is at least one spray nozzle.

9. The dryer of claim of claim 1 wherein the internal surface of the chamber contains projections.

10. A process for drying wet material comprising introducing the wet material into a chamber of an oscillating vacuum chamber dryer, applying a vacuum to the chamber through a vacuum port, and rocking the chamber back and forth in an oscillatory manner to cause the wet material to flow back and forth from one end of the chamber to the other, continuously exposing fresh surface area, until the material has dried.

11. The process of claim 10 further comprising monitoring the pressure of the vacuum chamber and stopping the vacuum when the pressure drop indicates the completion of the drying.

* * * * *